US005494172A

United States Patent [19]

Siesco, Jr.

[11] Patent Number: 5,494,172

[45] Date of Patent: Feb. 27, 1996

[54] MAGNETIC PULLEY ASSEMBLY

[75] Inventor: Leonard E. Siesco, Jr., Fredonia, Wis.

[73] Assignee: Miller Compressing Company, Milwaukee, Wis.

[21] Appl. No.: 241,707

[22] Filed: May 12, 1994

[51] Int. Cl.[6] ..... B03C 1/00

[52] U.S. Cl. ..... 209/212; 209/219; 209/642

[58] Field of Search ..... 209/212, 216, 209/219, 225, 226, 227, 636, 642, 213

[56] References Cited

U.S. PATENT DOCUMENTS

| | | | |
|---|---|---|---|
| 2,272,719 | 2/1942 | Maynard | 209/219 |
| 3,028,708 | 4/1962 | Vaughan et al. | 209/219 X |
| 3,448,857 | 6/1969 | Benson et al. | 209/212 |
| 3,454,913 | 7/1969 | Israelson et al. . | |
| 3,455,276 | 7/1969 | Anderson | 209/219 X |
| 4,224,350 | 9/1980 | Merck | 209/642 X |
| 4,230,560 | 10/1980 | Nakajima | 209/212 |
| 4,834,870 | 5/1989 | Osterberg et al. | 209/212 X |
| 4,869,811 | 9/1989 | Wolanski et al. | 209/212 |
| 5,057,210 | 10/1991 | Julius | 209/219 X |
| 5,080,234 | 1/1992 | Benson | 209/212 |
| 5,092,986 | 3/1992 | Feistner et al. | 209/219 X |
| 5,108,587 | 4/1992 | Walker | 209/212 |
| 5,207,330 | 5/1993 | Siesco, Jr. | 209/219 |

FOREIGN PATENT DOCUMENTS

| | | | |
|---|---|---|---|
| 0342330A2 | 3/1989 | European Pat. Off. . | |
| 106450 | 7/1898 | Germany | 209/219 |
| 2917488A1 | 1/1980 | Germany . | |
| 54-5269 | 1/1979 | Japan . | |
| 771090 | 3/1957 | United Kingdom . | |

*Primary Examiner*—William E. Terrell
*Assistant Examiner*—Tuan Nguyen
*Attorney, Agent, or Firm*—Foley & Lardner

[57] ABSTRACT

A magnetic repulsion assembly for separating copper particles from zinc particles, the assembly including a magnetic pulley having a radially decreasing flux density field surrounding the pulley, a belt wrapped around the magnetic pulley for supporting the particles and a resilient pulley mounted in close proximity to the magnetic pulley whereby the copper particles will be rotated into engagement with the surface of the resilient pulley and thrown outwardly therefrom at a greater trajectory than the zinc particles.

4 Claims, 2 Drawing Sheets

MAGNETIC PULLEY ASSEMBLY

FIELD OF THE INVENTION

The present invention relates to magnetic separators for separating nonferrous metals and more particularly to an improved apparatus for separating nonferrous metals.

BACKGROUND OF THE INVENTION

Magnetic pulleys are used to initially separate or sort ferrous and nonferrous metal pieces from scrap material travelling on a conveyor belt. Separators of this type are disclosed in U.S. Pat. No. 4,869,811, issued to Richard B. Wolanski, et al., on Sep. 26, 1989, entitled "Rotor For Magnetically Sorting Different Metals," U.S. Pat. No. 3,448,857, issued to W. H. Benson, et al., on Jun. 10, 1969, entitled "Electrodynamic Separator," and U.S. Pat. No. 3,454,913, issued to A. F. Israelson, et al., on Jul. 8, 1969, entitled "Permanent Magnetic Pulley." Each of these patents describes a magnetic pulley wherein a number of rows of magnets are arranged in spaced relation on the rotor to produce an alternating magnetic polarity flux field.

In my earlier U.S. Pat. No. 5,207,330, entitled "Magnetic Pulley," granted on May 4, 1993, a magnetic repulsion separator is described for separating a mixture of discrete particles having various electroconductivity characteristics. The separator generally includes a main shaft, a pair of main bearings for supporting the shaft and a hollow rotor mounted on the shaft. The rotor having an even number of axially aligned notches around the outer perimeter thereof. A row of permanent magnets are aligned in each of the notches with each alternate row of magnets having opposite polarity. An outer magnetic shell is mounted for rotary motion on the main shaft and encircles the hollow rotor carrying the discrete particles of metals. A conveyor belt is mounted on the magnetic shell for rotary motion about the hollow rotor.

SUMMARY OF THE PRESENT INVENTION

The present invention relates to a magnetic repulsion separator apparatus which improves the separation of the nonferrous metals and more particularly the separation of the copper particles from the zinc and brass particles.

It is generally understood that the degree of separation of the nonferrous metals depends upon the flux density around the perimeter of the magnetic pulley. The nonferrous metals, such as brass, zinc and copper, are separated by the flux density of the magnetic field that surrounds the magnetic pulley. The flux density of the magnetic field around the perimeter of the magnetic pulley decreases radially outwardly from the surface of the magnetic pulley. It is generally understood that copper particles are separated from the magnetic pulley by a flux density of 1000 gauss while zinc particles are separated from the magnetic pulley by a flux density of 1500 gauss. The trajectory of the particles is such that the differentiation in separation is so close that makes it difficult to achieve a complete separation of the copper from the zinc.

In accordance with the present invention a secondary pulley having a resilient surface is placed in close proximity to the magnetic pulley so that the copper particles are forced against the resilient surface of the secondary pulley which forces the copper particles into the higher flux field which forces the copper particles outwardly from the magnetic pulley so that they fall at a greater distance from the zinc particles.

It has also been noted that by positioning a water cooled shield under the belt in close proximity to the magnetic pulley the copper and zinc particles are lifted from the conveyor at substantially the same time. However, the copper particles will be separated by the higher gauss field around the magnetic pulley into the path of motion of the secondary pulley which propels the copper particles axially outwardly a greater distance than the zinc particles.

A principal feature of the present invention is the use of a rubber lined pulley to force the copper particles into the high density flux field about the magnetic pulley to thereby propel the copper particles a greater distance from the pulley than the zinc particles.

A further feature of the present invention is the provision of a water cooled shield located in close proximity to the magnetic pulley to delay the entry of the copper particles into the high density flux field and thereby subject the copper particles to a greater magnetic force.

Other principal features and advantages of the invention will become apparent to those skilled in the art upon review of the following drawings, the detailed description and the appended claims.

Figure 1:
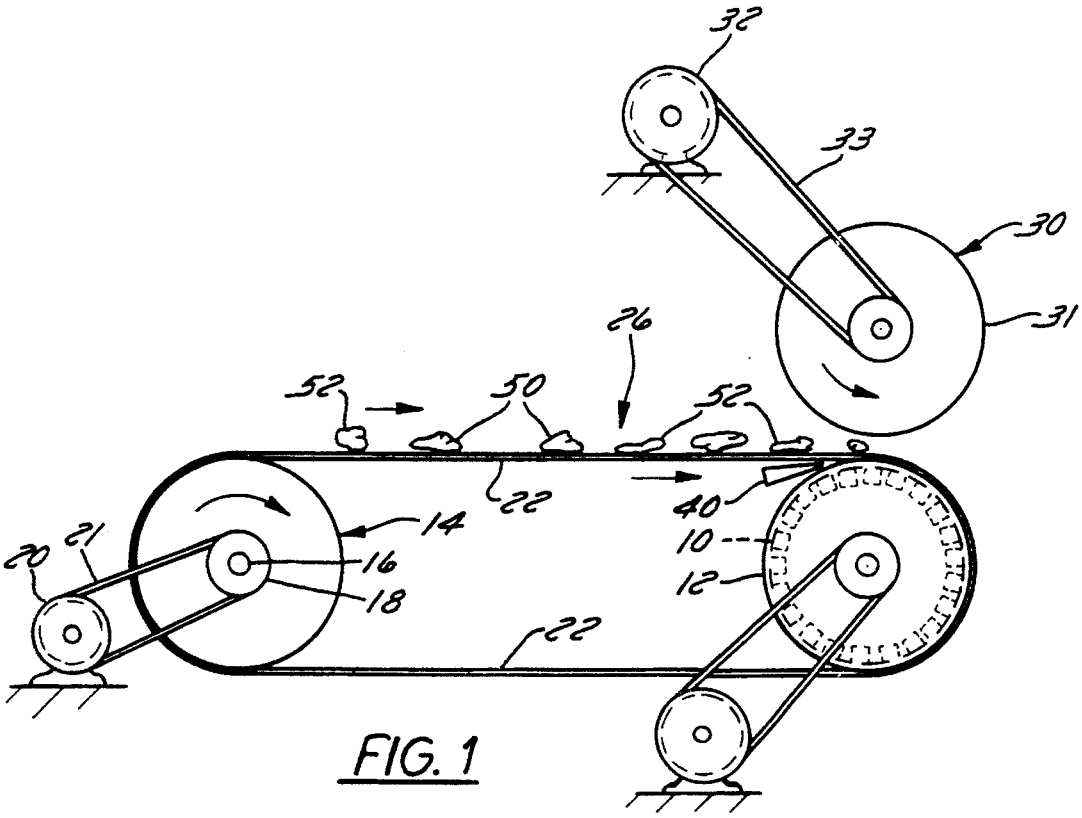
FIG. 1 is a side view of the magnetic separator with the rubber covered pulley shown located in close proximity to the magnetic pulley and the water cooled shield positioned between the conveyor belt and the magnetic rotor.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Referring to FIG. 1 a magnetic pulley 10 is shown mounted for rotation within a conveyor pulley 12 which is in the form of a thin walled nonmagnetic cylinder. A rear pulley 14 is rotatably mounted on a shaft 16 in a spaced relation to the pulley 12. The drive pulley 18 is connected to a variable speed motor 20 by a drive belt 21. A conveyor 22 is formed of a nonmagnetic material and is supported by the pulleys 12 and 14. The nonferrous metal 26 is carried by the conveyor belt 22 through the high flux density magnetic field produced by the magnetic pulley 10. The rapidly changing flux field induces an eddy current in the particles which produces a repulsive magnetic force on the conductive particles. That repulsive force along with the inertia due to the forward movement of the particles along the conveyor belt discharges the particles forwardly in a downward trajectory. The trajectories of the particles are proportional to the kinds of metal of which they are formed.

In accordance with the present invention an impeller pulley 30 is positioned in close proximity to the surface of the pulley 12. The pulley 30 has a rubber cover 31 mounted on the outer surface thereof and is driven by a variable speed motor 32 by a drive belt 33. The speed of rotation of the magnetic pulley 10 can be set at the same speed as the pulley 12 or increased in speed where greater separation of the copper particles from the zinc particles is desired.

A hollow copper shield 40 is positioned at the intersection of the belt 22 with the surface of the pulley 12. Water is circulated through the shield 40 to block the high density flux field so that the particles to be separated enter the high density flux field at the same time as described hereinafter.

Figure 2:
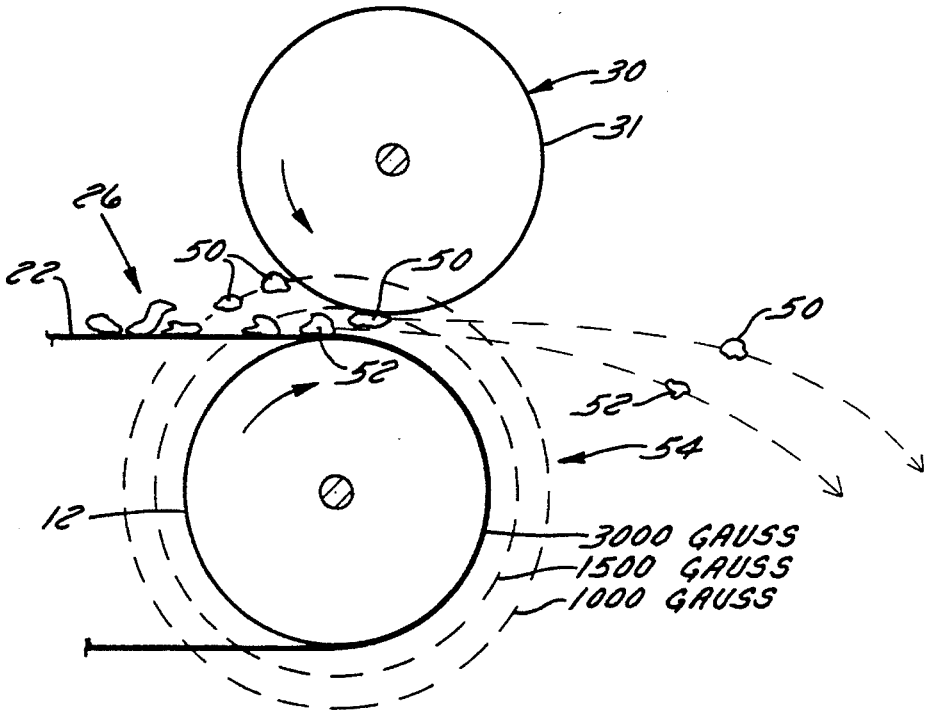
FIG. 2 is a side view of the magnetic separator showing the relation of the resilient pulley to the field around the magnetic pulley.

Referring to FIG. 2 the belt 22 is shown wrapped around the pulley 12 with the copper particles 50 and zinc particles 52 shown carried by the belt onto the pulley 12. The flux fields 54 are shown surrounding the pulley 12. The density of the flux fields around the surface of the pulley 12 are approximately 3000 gauss on the surface of the pulley 12, 1500 gauss one-half inch from the pulley 12 and 1000 gauss one inch from the pulley 12. The zinc particles 52 are carried in the force field between the surface of the pulley 12 and the 1500 gauss field. The copper particles 50 are carried in the force field between 1500 gauss and 1000 gauss. The trajectory of the copper particles 50 and zinc particles 52 are shown as they come off of the pulley 22 in a spaced relation.

The pulley 30 is shown partially penetrating into the low density force field between 1500 and 1000 gauss. As the copper particles 50 engage the side wall of the pulley 30, they are forced into the high density force field between 1500 gauss and 3000 gauss. The copper particles 50 are then propelled outwardly from the zinc particles 52 by the rotary motion of the pulley 30 and the repelling influence of the higher gauss field around the pulley 12, thus providing a greater separation in the trajectory of the copper particles 50 and zinc particles 52.

Figure 3:
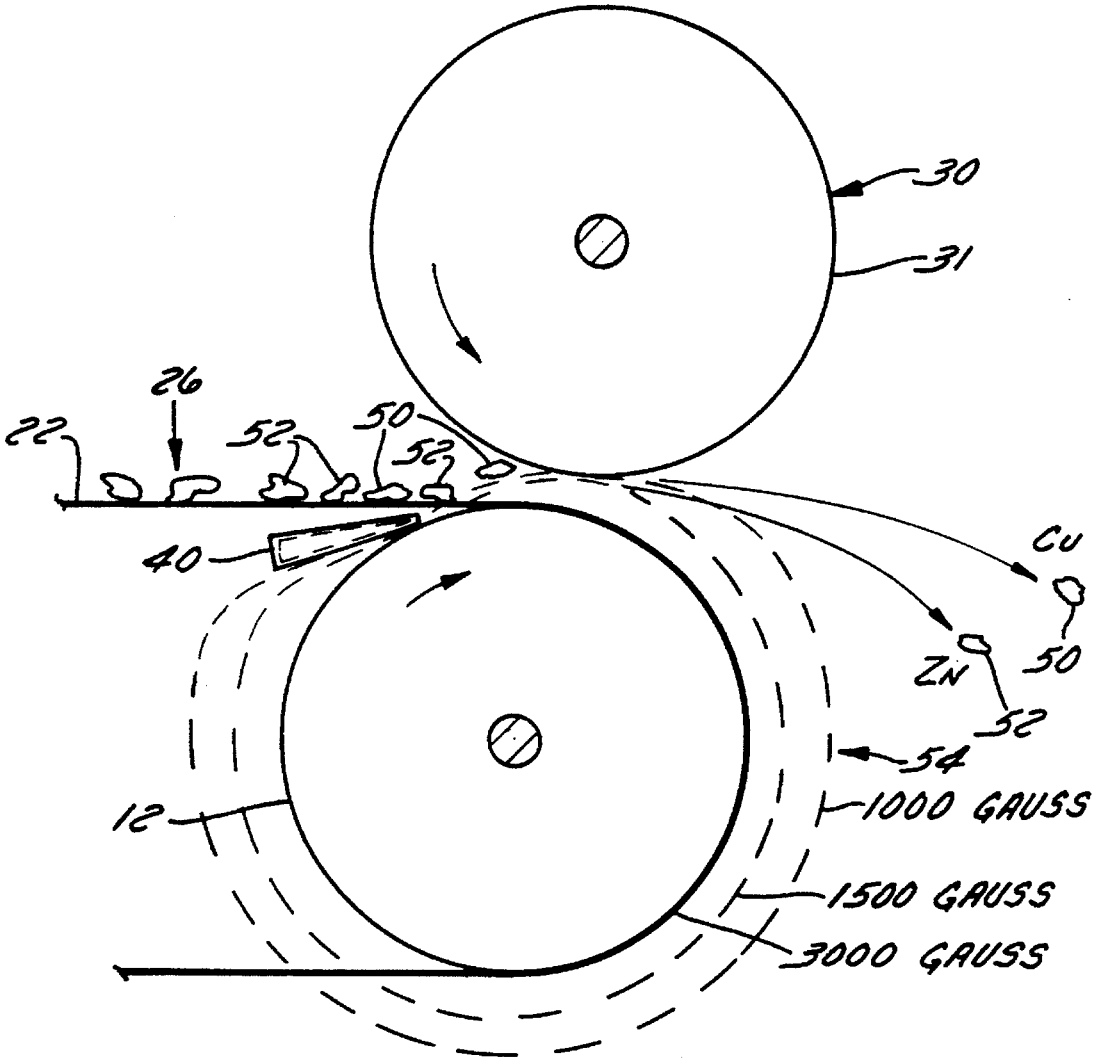
FIG. 3 is a side view similar to FIG. 2 showing the effect of the cooling shield on the flux field around the magnetic pulley.

Referring to FIG. 3 the hollow shield 40 is shown positioned in the space between the belt 22 and the pulley 12. Water may be circulated through the shield 40 to reduce the temperature. The shield 40 is positioned to interrupt the flux field as shown in FIG. 3. The interruption of the force field causes the copper particles 50 and zinc particles 52 to simultaneously enter the high density flux field. The copper particles 50 are propelled by the high density flux field into engagement with the rubber pulley 30. The impact of the copper particles 50 will force the copper particles into the higher gauss field around the pulley 12. The increased forces of the high flux field propels the copper particles a greater distance than the zinc particles.

Although this description of the magnetic pulley assembly has been described in connection with the separation of copper and zinc, other nonferrous metals could also be separated by the described apparatus.

Thus, it should be apparent that there has been provided in accordance with the present invention a magnetic pulley assembly that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A magnetic repulsion assembly for separating low density copper particles from high density zinc particles, the assembly including a conveyor pulley, a drive pulley, a conveyor belt wrapped around the drive pulley and the conveyor pulley for supporting the particles to be separated, a magnetic pulley having a radially decreasing flux density field mounted in the conveyor pulley, means for rotating the magnetic pulley to radially separate the low density copper particles from the high density zinc particles and an impeller pulley having a resilient cover mounted in close proximity to the conveyor pulley whereby the low density copper particles will be forced into the high density force field, whereby said low density copper particles will be propelled outwardly from the zinc particles by the rotary motion of the conveyor pulley and the repelling influence of the higher gauss field at a greater distance than the zinc particles.

2. The assembly according to claim 1 wherein a water cooled shield is positioned in close proximity to the intersection of the belt with the magnetic pulley to interrupt the flux field so that the low density copper particles on entering the flux field will be forced outwardly into contact with the impeller pulley by the repelling force of the high flux field and thereby thrown outwardly from the impeller pulley a distance greater than the high density zinc particles.

3. A magnetic repulsion assembly for separating nonferrous particles of copper from nonferrous particles of zinc, the assembly comprising a conveyor for transporting the nonferrous particles, a magnetic pulley positioned in close proximity to the conveyor, means for rotating the magnetic pulley to provide a radially decreasing flux density field surrounding the magnetic pulley, the nonferrous particles of copper being separated from the nonferrous particles of zinc in response to the flux density field, a pulley having a resilient material on the outer surface positioned in the flux density field in a spaced relation to the magnetic pulley for forcing the copper particles into the high density field surrounding the magnetic pulley whereby said copper particles are projected outwardly from the zinc particles a distance greater than the zinc particles.

4. A magnetic repulsion assembly for separating copper particles from zinc particles, the assembly including a magnetic pulley having a radially decreasing flux density field surrounding the magnetic pulley, a belt wrapped around the magnetic pulley for supporting the particles to be separated and a resilient pulley mounted in close proximity to the upper surface of the magnetic pulley whereby the copper particles will be rotated into engagement with the surface of the resilient pulley and thrown outwardly therefrom at a greater trajectory than the zinc particles and further including a water cooled shield positioned in close proximity to the intersection of the belt with the magnetic pulley to interrupt the flux field so that the particles enter the flux field simultaneously whereby the copper particles will be forced into contact with the resilient pulley by the repelling force of the high gauss field.

* * * * *